US005377891A

United States Patent [19]

Peltzer et al.

[11] Patent Number: 5,377,891

[45] Date of Patent: Jan. 3, 1995

[54] PROCESS FOR CONTROLLING THE FORCE ON A MOVING WEB OF MATERIAL

[75] Inventors: Dieter Peltzer, Krefeld; Heinz Hermanns, Korschenbroich; Hans Seibold, Anhausen, all of Germany

[73] Assignee: Erhardt & Leimer GmbH, Augsburg, Germany

[21] Appl. No.: 950,474

[22] Filed: Sep. 24, 1992

[30] Foreign Application Priority Data

Sep. 24, 1991 [DE] Germany ..... 4131760

[51] Int. Cl.[6] ..... B65H 43/00

[52] U.S. Cl. ..... 226/024; 226/019

[58] Field of Search ..... 226/19, 20, 24, 27, 226/28, 30, 37, 42; 242/75, 75.2; 19/300; 26/74, 75; 28/185, 194

[56] References Cited

U.S. PATENT DOCUMENTS

| | | | |
|---|---|---|---|
| 3,032,245 | 5/1962 | George et al. | 242/75.2 |
| 3,081,700 | 3/1963 | Kieckhefer, Jr. | 226/28 X |
| 3,684,273 | 8/1972 | Benson et al. | 242/75.43 X |
| 3,782,649 | 1/1974 | Frederick et al. | 226/42 X |
| 4,216,804 | 8/1980 | Alexander, III et al. | 242/75 X |
| 4,339,118 | 7/1982 | Burton et al. | 270/31 |
| 4,380,330 | 4/1983 | Smith et al. | 270/31 |
| 4,573,618 | 3/1986 | Kikuchi | 242/62 X |
| 4,632,325 | 12/1986 | Feyerl et al. | 242/55 |
| 5,240,194 | 8/1993 | Noirot et al. | 226/42 X |

FOREIGN PATENT DOCUMENTS

| | | | |
|---|---|---|---|
| 63-180682 | 7/1988 | Japan | 242/75 |
| 1-48763 | 2/1989 | Japan | 242/75 |
| WO92/10419 | 6/1992 | WIPO | 226/28 |

*Primary Examiner*—Daniel P. Stodola
*Assistant Examiner*—John P. Darling
*Attorney, Agent, or Firm*—Collard & Roe

[57] ABSTRACT

An process for controlling the force exerted on a moving web of material, including a batten roller having an adjustable drive and a fixing roller having a pressure sensor. An amplifier is coupled between the pressure sensor and the adjustable drive. A web pulling device pulls the web in a downstream direction across the batten roller and the fixing roller. The pressure sensor generates a first signal representing the tensile force on the web as it passes the fixing roller. The first signal is amplified to provide a control signal to the drive for adjusting the speed of the batten roll.

2 Claims, 1 Drawing Sheet

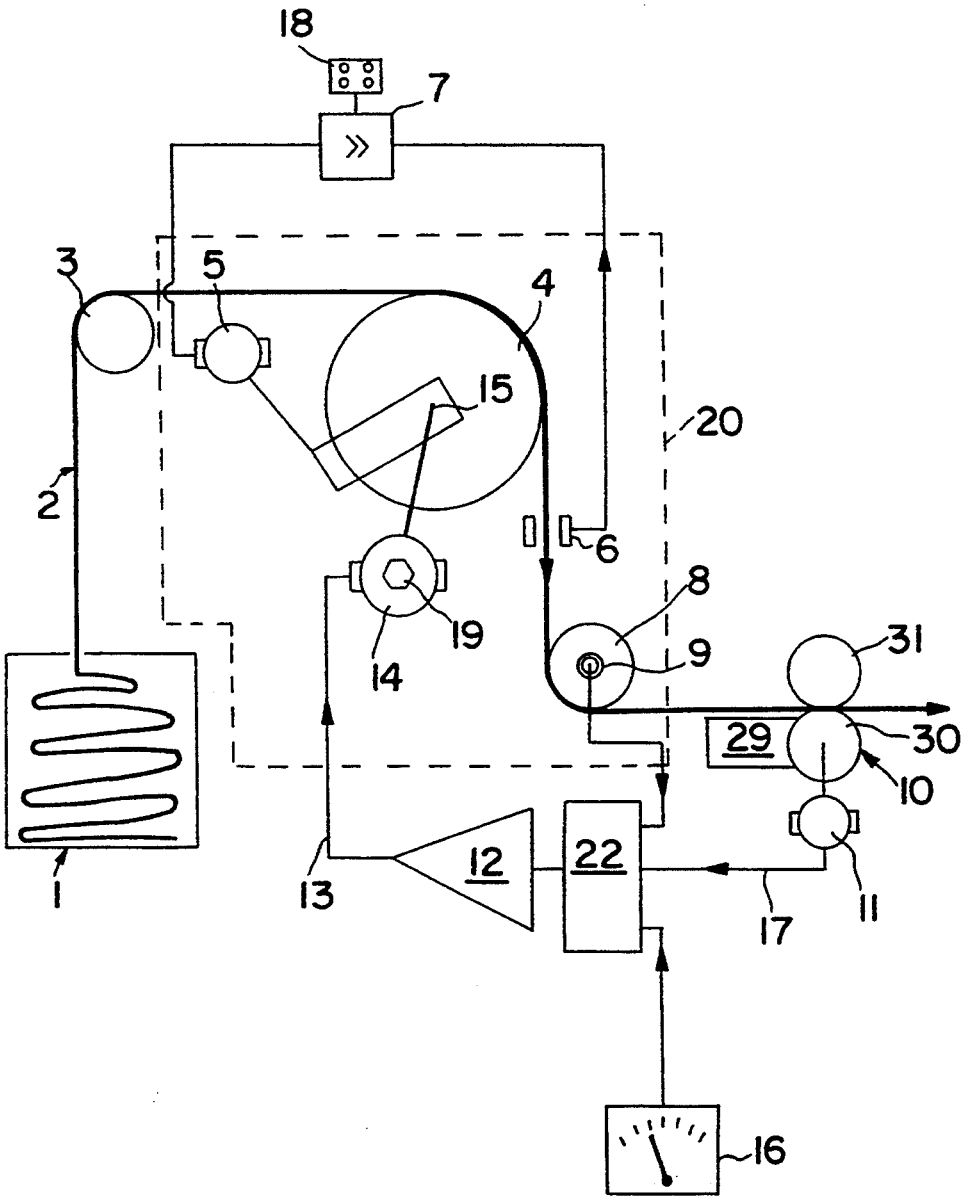
18
7
3
5
4
15
20
2
6
8
19
9
31
14
29
30
10
12
22
1
13
17
11
16

PROCESS FOR CONTROLLING THE FORCE ON A MOVING WEB OF MATERIAL

BACKGROUND OF THE INVENTION

1. Field of the Invention

The present invention relates to a process and apparatus for controlling the force on a moving web of material. More specifically, it relates to a process and apparatus for taking a web of material from a container and adjusting its width by controlling the force exerted on the web.

2. The Prior Art

Processing webs of material taken from supply containers is known in the art. The web of material must be spread out and properly guided and aligned throughout the apparatus in order to be treated or wound onto a take-up reel. Spreading rolls are provided to eliminate folds as the web exits the supply container. Guiding and breadth-stretching rolls are also provided if the material web has to be guided during spreading in a certain direction, or if its direction of travel has to be corrected. However, a drawback exists in that the web which has been spread on the breadth-stretching roll or batten roll will retract to a narrower width before it is received by a fixing roll which stabilizes the width of the web. The extent to which the web retracts or is overstretched depends on the force with which the web of material is pulled across the batten roll to the fixing roll.

The batten roll is rotated based on the adhesion of the web material as it travels across the batten roll. The web is smoothed by lateral movement of the batten roll, depending on the condition and direction of travel of the web as it moves across the batten roll. In this type of arrangement, different forces are continually exerted on the web, which leads to considerable stress on the fabric. This results in a completely distorted web of fabric which adversely affects the further treatment and processing of the material web.

One attempt to avoid the application of excessive loads to a roll of material is described in U.S. Pat. No. 4,632,325 to Feyerl et al. Feyerl provides an apparatus for unwinding a web from a roll including a roll bearing for supporting the roll. A controller positions the roll with respect to the roll bearing to avoid an application of excessive loads to the web. However, Feyerl cannot be used with a web which is being drawn from a container. Also, Feyerl does not provide means for adjusting the width of the web after it is unwound from the roll.

SUMMARY OF THE INVENTION

It is therefore an object of the present invention to provide a process and apparatus which overcomes the aforementioned drawbacks and accurately controls the force exerted on a web of material.

It is a further object of the present invention to provide a process and apparatus which spreads and aligns material which is to be stabilized on a fixing roll.

It is still a further object of the present invention to provide a process and apparatus in which the web is stabilized on the fixing roll without deformations and distortions.

It is yet another object of the present invention to provide a process and apparatus in which the web is stabilized on the fixing roll with a constant tensile force.

These and other related objects are achieved according to the invention by a process and apparatus for controlling the force exerted on a moving textile web or web of material. The apparatus includes a batten roller having adjustable drive means and a fixing roller having pressure sensing means coupled thereto. An amplifier is coupled between the pressure sensing means and the adjustable drive means. Web pulling means pull the web in a downstream direction across the batten roller and fixing roller. The pressure sensing means generates a first signal representing the tensile force on the web as it passes the fixing roller. The first signal is amplified by the amplifier to provide a control signal to the drive means for adjusting the speed of the batten roller.

An adjustable controller for selecting a predetermined tension value is coupled to the amplifier. A tachometer is coupled to a drive located downstream of the fixing roller for generating a second signal representing the rotational speed of the drive. The controller and the amplifier cooperatively provide a control signal to the drive means based on a comparison of the first signal and the second signal with the predetermined tension value.

The process for controlling the force exerted on a moving textile web includes the steps of pulling the web across a batten roller and a fixing roller to guide and spread the web. A first signal is generated representative of the pressure exerted on the web as it passes the fixing roller. The signal is amplified to control the speed of the batten roller and adjust the force exerted on the web.

The fixing roll is supported by pressure measuring cells or sensors which measure the pressure exerted on the web as it changes direction across the fixing roll. A signal representative of the force controls the speed of the batten roll to accelerate or decelerate its speed. A continuous force is thus exerted on the web so that spreading of the web may take place in a balanced fashion without distortion, even with very sensitive fabrics. When large lateral forces are exerted on the web, the web pulling force increases as well, which is compensated by a higher speed of the batten roll. With a smooth, straight run of the web, the web pulling force decreases. In such a case, control signals transmitted from the fixing roller reduce the speed of the batten roll so that an even force is exerted on the web between the batten roller and the fixing roller to avoid distortions of the web.

BRIEF DESCRIPTION OF THE DRAWINGS

Other objects and features of the present invention will become apparent from the following detailed description considered in connection with the accompanying drawing which discloses an embodiment of the present invention. It should be understood, however, that the drawing is designed for the purpose of illustration only and not as a definition of the limits of the invention.

The figure is a schematic showing the process and apparatus according to the invention.

DETAILED DESCRIPTION OF PREFERRED EMBODIMENTS

Turning now in detail to the drawing, there is shown a textile web 2 dispensed from a container 1 and spread across a spreading roll 3. Web 2 then passes to a guiding and breadth-stretching roll or segmented control roll or batten roll 4 which spreads web 2 to eliminate folds. Batten roll 4 is movable laterally by means of a servo motor 5. Web 2 then passes through sensors 6 which scan the marginal edge of web 2 to determine its position. An adjustment device 7 is coupled between sensors 6 and servo motor 5. Adjustment device 7 directs servo motor 5 to adjust the position of batten roll 4 along its axis laterally so that web 2 passes through sensors 6 properly aligned, free of folds and without retracting. A fixing roll 8 is located immediately following batten roll 4. Fixing roll 8 includes pressure measuring cells or detectors 9 on one or both ends of its axle. Pressure measuring cells 9 measure the force exerted on the web as web 2 is pulled from batten roll 4 to fixing roll 8. Material 2 is looped by at least 90° around fixing roll 8 and then passes to a material web pulling device 10. A tachometer 11 is provided on pulling device 10 to generate a signal corresponding to the speed of the web. This signal is transmitted along line 17 to amplifier 12. Pulling device 10 consists of a motor 29 driving a wheel 30 and an idler wheel 31, for example. Web 2 runs between wheel 30 and idler wheel 31.

The force exerted on web 2 as it passes around fixing roll 8 is sensed by pressure measuring cells 9 which is coupled to an amplifier 12. Pressure measuring devices 9 generate a signal which is amplified and then transmitted via line 13 to a drive 14 which is coupled to batten roll 4. Drive 14 is an electric motor provided with gearing 19 which is flanged onto the motor. Gearing 19 is connected to an axle 15 of batten roller 4.

An adjustable controller 16 for selecting a predetermined tension value and a tachometer 11 are coupled to amplifier 12 via line 17 and a switching arrangement 22. The running speed of the web can thus be compensated for when amplifier 12 sends control signals to drive 14. A further controlling device 18 is coupled to adjustment device 7 to adjust the sensitivity of sensors 6.

As web 2 runs across batten roll 4 and is spread and shifted into position, as directed by sensors 6, considerable and varying stresses occur in web 2 due to different tensile forces acting on the web. As a result, the structure of the fabric becomes distorted, particularly if the material has a wide mesh. To avoid this, the force exerted on the web downstream of batten roll 4 must be constant and balanced, until the web is stabilized on fixing roll 8. Drive 14 feeds web 2 to fixing roll 8 at either a higher or lower rate to maintain a constant force. In this manner, even difficult and sensitive fabrics may be desirably spread without creating undesirable distortions in the material.

Batten roll 4, with its drive 14, fixing roll 8, and amplifier 12, along with its associated switches and electrical connection, are formed as a single constructional unit 20. Unit 20 is mounted on a console (not shown for reasons of clarity) which is flange mounted to the remaining equipment. Unit 20 can then be installed or removed from the processing line of web 2 simply and quickly.

It should be noted that the link between tachometer 11 and pressure measuring cells 9 allows particularly fine tuning of the control signals for drive 14. This fine adjustment, in combination with the predetermined tension value selected in controller 16, makes it possible to process any material, including strong and delicate fabric. The material is fixed in its position under a uniform and balanced tension so that the material can be further treated without difficulty.

Drive 14 can be simply flanged directly onto axle 15. To provide even more sensitive control, a transmission may be provided between drive 14 and axle 15. Alternatively, a hydraulic motor can be provided to provide a sensitive drive. The predetermined tension value set in controller 16 is prescribed as a basic value. The basic value must be determined with regard to the web force measurements. The driving or braking moment of drive 14 is determined based on this measurement.

While only a single embodiment of the present invention has been shown and described, it is to be understood that many changes and modifications may be made thereunto without departing from the spirit and scope of the invention as defined in the appended claims.

What is claimed is:

1. A process for controlling the force exerted on a moving web of material, comprising the steps of:

selecting a predetermined tension valve;

pulling the web across a guiding and breadth-stretching roller and a fixing roller to guide and spread the web;

generating a first signal representative of the force exerted on the web as it passes the fixing roller;

generating a second signal representative of the rotational speed of a driven wheel located downstream of the fixing roller;

generating a control signal by (i) comparing the first signal to the predetermined tension value, and (ii) compensating for the running speed of the web based on the second signal;

amplifying the control signal; and controlling the speed of the guiding and breadth-stretching roller dependent upon the amplified control signal so that a constant predetermined force is exerted on the moving web whereby difficult and sensitive fabrics are spread without creating undesirable distortions in the fabric.

2. The process according to claim 1, additionally including the steps of:

scanning the edge of the web as it leaves the guiding and breadth-stretching roller with sensors; and shifting the guiding and breadth-stretching roller along its axis so that the web passes through the sensors free of folds and properly aligned, prior to the step of generating a first signal.

* * * * *